United States Patent [19]

Murray

[11] Patent Number: 4,654,170

[45] Date of Patent: Mar. 31, 1987

[54] HYPOHALITE OXIDATION IN DECONTAMINATING NUCLEAR REACTORS

[75] Inventor: Alexander P. Murray, Murrysville, Pa.

[73] Assignee: Westinghouse Electric Corp., Pittsburgh, Pa.

[21] Appl. No.: 617,460

[22] Filed: Jun. 5, 1984

[51] Int. Cl.[4] ..... G21F 9/00; C23G 1/02

[52] U.S. Cl. ..... 252/626; 134/3; 134/27; 134/28; 252/82; 252/86; 252/631; 376/310

[58] Field of Search ..... 252/626, 631, 80, 82, 252/86, 142, 146; 134/2, 3, 22.17, 22.19, 26, 27, 28, 29, 38, 41; 376/309, 310; 204/149, 153, 141.5

[56] References Cited

U.S. PATENT DOCUMENTS

| | | | |
|---|---|---|---|
| 3,013,909 | 12/1961 | Pancer et al. | 252/626 |
| 3,080,262 | 3/1963 | Newman | 134/3 |
| 3,496,017 | 2/1970 | Weed | 134/2 |
| 3,522,093 | 7/1970 | Woolman | 134/3 |
| 3,615,817 | 10/1971 | Jordan et al. | 252/626 |
| 3,664,870 | 5/1972 | Oberhofer et al. | 252/626 |
| 3,717,580 | 2/1973 | Echols et al. | 252/106 |
| 4,167,561 | 9/1979 | Lamberti et al. | 252/94 |
| 4,287,002 | 9/1981 | Torok | 134/3 |
| 4,537,666 | 8/1985 | Murray et al. | 204/129.95 |
| 4,587,043 | 5/1986 | Murray et al. | 252/626 |

FOREIGN PATENT DOCUMENTS

| | | |
|---|---|---|
| 1047256 | 11/1966 | United Kingdom . |
| 1098909 | 1/1968 | United Kingdom . |

*Primary Examiner*—Stephen J. Lechert, Jr.
*Assistant Examiner*—Howard J. Lockin
*Attorney, Agent, or Firm*—R. D. Fuerle

[57] ABSTRACT

Disclosed is an oxidizing composition of water, about 0.1 to saturation of an alkali metal hypohalite, and sufficient alkali metal hydroxide to raise the pH of the solution to at least about 12. A method of decontaminating metal surfaces having a coating thereon which contains radioactive substances is also disclosed. The composition is passed over the coating at a temperature of about 50° to about 120° C. followed by passing a decontamination solution over the coating.

7 Claims, No Drawings

HYPOHALITE OXIDATION IN DECONTAMINATING NUCLEAR REACTORS

CROSS-REFERENCE TO-RELATED APPLICATION

This application is related to application Ser. No. 501,980, filed June 7, 1983 by A. P. Murray et al., titled "Decontamination of Metal Surfaces in Nuclear Power Reactors," now U.S. Pat. No. 4,587,043.

BACKGROUND OF THE INVENTION

Water or various gases are used in many types of unclear reactors to remove heat from the reactor core, which is then directly or indirectly used to generate electricity. In a pressurized water reactor (PWR) water circulates between the reactor core and a steam generator in a primary loop. In the steam generator the heat is transferred to a secondary loop of water which forms steam which then runs turbine electric generators. In a boiling water reactor (BWR) the water in the primary loop is under less pressure so that, after heating in the nuclear core, it is in a gaseous form. In other types of nuclear reactors, such as high temperature gas reactors (HTGR), a gas such as carbon dioxide or helium transfers heat from the reactor core to the steam generator.

Regardless of whether the heat transfer medium is water or a gas, however, it picks up contaminants and corrosion products from the metals with which it is in contact. The contaminants are radioactivated in the nuclear core, and then deposit on metal surfaces in the cooling system. These contaminants include chromium which enters the coolant when base metals such as stainless steel or Inconel corrode. Chromium (+6) is soluble (e.g., as dichromate, $Cr_2O_7^{--}$) but chromium (+3) forms an oxide with a spinel structure, which is very difficult to remove from the metal surfaces. Such spinel-like oxides include chromium substituted nickel ferrites, such as $Cr_{0.2}Ni_{0.6}Fe_{2.2}O_4$, which tend to form under the reducing conditions found in pressurized water reactors. The deposits can also contain nickel ferrite, hematite, magnetite, and various radionuclides. Hematite, $Fe_3O_4$, and, to a lesser extent, nickel ferrite, $NiFe_2O_4$, tend to form under the oxidizing conditions found in boiling water reactors, but these are easier to remove than chromium substituted ferrites. Radionuclides in the deposits can come from non-radioactive ions that enter the coolant and are made radioactive by neutron bombardment in the core. For example, cobalt from hard facing alloys, which are used in seals and valve facings, can go from non-radioactive cobalt 59 to highly hazardous and radioactive cobalt 60 when bombarded by neutrons. Also, stable nickel 58, from high nickel alloys (e.g., Inconel), can be irradiated to produce radioactive cobalt 58.

These deposits can form on the inside surfaces (primary surfaces) of the primary loop of a pressurized water reactor, or in the steam generator, or in the piping in between. The deposits could also form on the steam generating side (secondary surfaces) of the steam generator, but there the problem is much less severe because the radioactivity is lower and the deposits are more easily dissolved. In a boiling water reactor the deposits can form on turbine blades or in any part of the cooling loop. In a high temperature gas reactor, the deposits can form on the primary cooling loop. Generally, the deposits formed in pressurized water reactors are the most difficult to remove, so if a process and composition can remove those deposits, it can also remove deposits formed in other types of reactors.

While the deposits are usually too thin to plug any of the tubing, they represent a safety hazard to personnel because of their high radioactivity. Thus, in order to inspect the cooling system and perform maintenance on it, it is necessary to decontaminate it first so that the hazard to humans is reduced or eliminated. In addition to the radiation hazard the deposits present, they also prevent the formation of a good seal when tubing must be repaired. This is done by "sleeving," inserting a new, smaller tube into the old tube and swaging the tubes together. In a steam generator it is necessary to hone a tube with an abrasive to remove the oxide layer down to clean metal in order to obtain a good seal by swaging or brazing. Because this is a time-consuming task, it increases the radiation exposure to the technician.

In spite of their thinness, (usually only about 2 to 5 microns), radioactive deposits in the cooling systems of nuclear reactors are very tenacious and difficult to remove. Many techniques have been tried to eliminate these deposits. Inhibitors have been added to the coolant system, but most inhibitors break down under the extreme conditions of temperature and radiation, and, in doing so, may form corrosive products. Continuous precipitation of the ions forming the deposits has been found to be ineffective. Many decontamination solutions which have been tried may themselves corrode the metals in the cooling system or may work too slowly to be economical. This is particularly true of concentrated reagents, which may require shutting down the power plant for several months. Speed in decontaminating is important because a generator which is shut down can cost a utility a million dollars a day in lost electricity.

SUMMARY OF THE INVENTION

We have discovered that metal surfaces coated with compounds containing radioactive substances can be effectively decontaminated by contact with an aqueous solution of an alkali metal hypohalite at a pH of at least 12 followed by contact with a decontamination solution. Unlike the alkali metal permanganate oxidizing solutions previously used, the oxidizing solution of this invention is transparent and dilute. Transparency is an advantage because it enables the operator to observe the effectiveness of the oxidation of the coating and alter process parameters accordingly to increase the effectiveness. Because the oxidizing solutions of this invention are dilute they result in a much smaller quantity of radioactive waste which must be disposed of. While the alkali permanganate oxidizing solutions tended to deposit manganese on the coating, which had to be redissolved prior to dissolution of the coating, the oxidizing solution of this invention does not form precipitates when in use. Finally, the oxidizing solution of this invention is at least as effective as alkali permanganate in decontaminating the metal surfaces of nuclear reactors.

DESCRIPTION OF THE INVENTION

The oxidizing solution used in the process of this invention is an aqueous solution of an alkali metal hypohalite and an alkali metal hydroxide. The oxidizing solution converts insoluble $Cr^{+3}$ (in the oxide film represented as $Cr_2O_3$) to soluble $Cr^{+6}$ (actually $Cr_2O_7^{--}$, dichromate) by the reaction (for hypobromite):

$$Cr_2O_3 + 3NaBrO + 2NaOH \rightarrow (Cr^{+3}\ \text{oxide}).$$

$$3NaBr + Na_2Cr_2O_7 + H_2O$$

$$(E^0 = .89\ V).$$

This is necessary because radionuclides are immobilized in the lattice structure of the oxide deposits, and the chromium content renders it insoluble.

The alkali metal hypohalites in the oxidizing solution include hypobromites, hypoiodites and hypochlorites. The use of hypochlorites is preferably restricted to the end-of-life decommissioning of nuclear hardware because free chloride ion is produced which will attack any stainless steel in the hardware and cause stress corrosion cracking. Caution must also be used when a hypoiodite is used because iodine can be converted to radioiodine which is absorbed by living organisms and can cause cancer. Hypobromites may cause some pitting of metals, but as yet this has not been found to be a problem. The hypohalite cation may be any alkali metal such as sodium or potassium. Of the two, sodium is preferred because sodium hypohalites are less expensive and more readily available. At least 0.1% (all percentages herein are by weight based on total solution weight) of the hypohalite should be used as less is ineffective. While the hypohalite may be used up to its solubility limit, more than about 2% has less and less effect and adds to the volume of waste which must be disposed of. The amount of alkali metal hydroxide should be sufficient to achieve a solution pH of at least 12 as the solution is less effective at lower pH levels. While any alkali metal hydroxide can be used, sodium hydroxide is preferred as it is less expensive and readily available.

The decontamination solution used in the process of this invention performs the function of solubilizing metal ions in the coating on the substrate and removing radionuclides by forming a complex with them. Suitable decontamination solutions are well known in the nuclear waste disposal art. For example, a suitable decontamination solution is water, about 0.2 to about 0.5% of an organic acid, and about 0.01 to about 0.4% of a chelate. Preferably, this decontamination solution is about 0.05 to about 0.3% of the organic acid and about 0.03 to about 0.2% of the chelate, the rest being water. If less organic acid is used, the decontamination factor (DF) falls off and if more organic acid is used, the apparatus being cleaned may corrode. Also, too much acid increases the quantity of ion exchange resin waste and may reduce the cation exchangeability. If less chelate is used, a precipitate may form which does not dissolve readily, and if more chelate is used, there will be a larger residual metal concentration in the solution due to less ion exchangeability; both effects decrease the DF. The total decontamination solution should have a pH between about 1.5 and about 4 and preferably between about 2 and 3 (the organic acid must only be capable of producing a pH of about 2 to about 3, but slightly higher and lower pH's are obtained in the presence of the chelate at higher temperatures). The temperature of the decontamination solution should be about 50° to about 120° C.

The acid in the decontamination solution is preferably organic because inorganic acids can leave residual ions which can cause corrosion problems in the reactor. Organic acids, on the other hand, decompose to produce only water and carbon dioxide. The organic acid should have an equilibrium constant for complexing with the ferric ion of at least about $10^9$ because the metal ions may precipitate if the equilibrium constant is less than about $10^9$. The organic acid should be capable of giving a pH of about 2 to about 3 in water because of a lower pH can cause corrosion and chelate precipitation, and a higher pH reduces the DF. Suitable organic acids include citric acid, tartaric acid, oxalic acid, picolinic acid, and gluconic acid. Citric acid is preferred because it is inexpensive, non-toxic, readily available, and has reasonable radiation stability.

The chelate should have an equilibrium constant for complexing with the ferric ion between about $10^{15}$ and about $10^{19}$. If the equilibrium constant of the chelate is less than about $10^{15}$ the metal ions may precipitate and a lower DF will be obtained. If it is greater than about $10^{19}$ the metal ions may not leave the complex with the chelate and attach to the ion exchange resin. The chelate preferably should be soluble in water having a pH of about 2 to about 3 at at least 0.4%. Also, the chelate should be in the free acid form, not in the salt form, because the cation which forms the salt would be removed on the ion exchange resin and then the resulting acid form might precipitate, plugging the column. Suitable chelates include nitrilotriacetic acid (NTA), and hydroxyethylenediaminetriacetic acid (HEDTA). NTA is preferred as it gives a higher DF, it is more soluble, it leaves less residual iron and nickel in the apparatus being decontaminated, it has the lowest solution activity levels of cobalt 60, and it can chelate more metal per unit of chelate.

The process of this invention can be applied to the decontamination of any metal surfaces coated with oxides containing radioactive substances. This includes the steam generator and primary and secondary loops of pressurized water reactors and boiling water reactors. The oxidizing solution has very little effect if used by itself and it should be followed by use of the decontamination solution. A minimum treatment would be oxidizing solution followed by decontamination solution, but a preferred treatment, which is more effective in decontaminating the surfaces, is to apply the decontamination solution first followed by the oxidizing solution and then a second application of the decontamination solution. If a really thorough decontamination is desired or necessary, these steps may be repeated, alternating oxidation steps with decontamination steps but beginning and ending with the decontamination steps. The oxidizing solution is circulated until the dichromate ion concentration in it no longer increases significantly. It can then be passed through an ion exchange column to remove radioactive ions. The decontamination solution is circulated between the metal surfaces and a cation exchange resin until the radioactivity level in it no longer increases significantly. It is preferable to rinse the apparatus with deionized water in between the oxidation and decontamination steps to prevent the oxidizing solution from oxidizing the chemicals in the decontamination solution instead of oxidizing the chromium in the oxide coating being treated. The oxidizing step is preferably conducted at about 50° to about 120° C., as higher temperatures may decompose the hypohalites and lower temperatures require too long a time. Also, it is difficult to obtain lower temperatures anyway due to the high radioactivity and residual heat from pumps and other sources. While the decontamination solution can be used at about 70° to about 200° C., depending upon the particular components in it, it is preferable to treat the apparatus with both solutions at the same temperature to avoid having to heat and cool the apparatus in between.

The following examples further illustrate this invention:

EXAMPLE

In these experiments sections of contaminated tubing from a steam generator of a pressurized water nuclear reactor were used. Each section of tubing was about ¾ of an inch in diameter and about 1 to 1½ inches long. Each section was cut longitudinally to provide two coupons. The coupons were placed in the beakers containing the various oxidizing and decontaminating solutions. The decontaminating solution ("CML") was a commercial citric acid/oxalic acid/EDTA solution.

The oxidizing solution was a stock solution that contained approximately 0.55M (about 2.2%) sodium hydroxide and 0.157M (1.9 wt%) sodium hypobromite (NaBrO), based upon the manufacturer's analysis. This was diluted to make a solution containing about 0.5% NaBrO and about 0.6% NaOH and 700 ml of the solution was placed in beakers and the results compared with 700 ml of other oxidizing solutions.

The following table gives the sequence of treatments and the results.

| Coupon | Treatment Sequence Step 1 | Step 2 | Step 3 | Final DF | Comments |
|---|---|---|---|---|---|
| A | .5% CML, 24 hrs., 100° C., no mixing | NaBrO soln. 6 hrs., 50° C., mixing | .5% CML, 4 hrs., 100° C., mixing | 6.7 | 1. Soln. a pale yellow color 2. OD oxide "flaked" a little: ID looks the same 3. Most activity released on the third step. |
| B | .5% CML, 24 hrs., 100° C., no mixing | NaBrO soln. 6 hrs., 100° C., mixing | .5% CML, 4 hrs., 100° C., mixing | 8.2 | 1. Soln. a pale yellow color 2. OD oxide "flaked" a little: ID looks the same 3. Most activity released on the third step |
| C | .5% CML, 4 hrs., 100° C., no mixing | .5% NaOH, .5% $KMnO_4$, 2 hrs., 100° C., no mixing | .5% CML, 4 hrs., 100° C., no mixing | 4.7 | Most activity released on the third step. |
| D | .5% CML, 4 hrs., 100° C., no mixing | .25% NaOH, .75% $KMnO_4$, no mixing | .5% CML, 4 hrs., 100° C., no mixing | 6.9 | Most activity released on the third step. |
| E | .5% CML, 4 hrs., 100° C., no mixing | 1% NaOH, 1% $KMnO_4$, 2 hrs., 100° C., no mixing | .5% CML, 4 hrs., 100° C., no mixing | 8.5 | Most activity released on the third step. |

The above experiments show that the sodium hypobromite solution compared very favorably with the alkali permanganate oxidation solution and appeared to produce a higher DF at the same total solution concentration, although exact comparisons cannot be made due to slight differences in experimental conditions. As with the alkali permanganate treatment, no activity removal occurred during the hypobromite step by itself.

I claim:

1. A method of decontaminating metal surfaces having an inorganic coating thereon which contains radioactive substances and spinel-like chromium oxides comprising:

(A) passing over said coating a decontamination solution which comprises (1) water;

(2) about 0.02 to about 0.5% of a water-soluble organic acid which has an equilibrium constant in a complex with ferric ion of at least $10^9$, and which is capable of producing a pH of about 2 to about 3 in water; and (3) about 0.01 to about 0.4% of a chelate in free acid form which has an equilibrium constant in a complex with ferric ion of about $10^{15}$ to about $10^{17}$, and which is soluble at at least 0.4% at 40° C. in water having a pH of about 2 to about 3, said chelate being selected from the group consisting of nitrilotriacetic acid, hydroxyethylenediaminetriacetic acid, and mixtures thereof;

(B) passing over said coating a composition heated to about 50° to about 120° C., said composition consisting essentially of (1) water;

(2) about 0.1% to saturation of an alkali metal hypohalite; and (3) sufficient alkali metal hydroxide to raise the pH of said composition to at least 12; and (C) passing said decontamination solution over said coating.

2. A method according to claim 1 wherein said alkali metal hypohalite is selected from the group consisting of sodium and potassium hypobromite, hypochlorite, hypoiodite, and mixtures thereof.

3. A method according to claim 1 wherein said alkali metal hypohalite is sodium hypobromite.

4. A method according to claim 1 wherein the concentration of said alkali metal hypohalite is about 0.1 to about 2%.

5. A method according to claim 1 including the additional last steps of repeating steps (A) and (B).

6. A method according to claim 1 including the additional steps of rinsing said coating with water after steps (A) and (B).

7. A method according to claim 1 wherein said chelate is nitrilotriacetic acid.

* * * * *